United States Patent [19]

Taylor, Jr. et al.

[11] Patent Number: 4,664,836

[45] Date of Patent: May 12, 1987

[54] DRAIN CLEANER

[75] Inventors: Roy M. Taylor, Jr., Rockford; Steven R. Klemm, Grand Rapids, both of Mich.

[73] Assignee: Amway Corporation, Ada, Mich.

[21] Appl. No.: 777,409

[22] Filed: Sep. 18, 1985

[51] Int. Cl.[4] ..... C11D 7/06; C11D 7/54; C11D 17/06; B08B 9/02

[52] U.S. Cl. ..... 252/91; 252/89.1; 252/102; 252/103; 252/156; 252/157; 252/174.13; 252/187.34; 134/22.13; 134/22.14; 252/186.2

[58] Field of Search ..... 252/103, 102, 99, 156, 252/157

[56] References Cited

U.S. PATENT DOCUMENTS

| | | | |
|---|---|---|---|
| 3,042,622 | 7/1962 | Kirschenbauer | 252/99 |
| 3,154,496 | 10/1964 | Roald et al. . | |
| 3,446,893 | 5/1969 | Hanford et al. . | |
| 3,454,427 | 7/1969 | Suzuki et al. . | |
| 3,697,431 | 10/1972 | Summerfelt et al. . | |
| 3,769,224 | 10/1973 | Inamorato | 252/99 |
| 3,793,211 | 2/1974 | Kohlhepp et al. . | |
| 3,936,385 | 2/1976 | Cheng . | |
| 3,968,048 | 7/1976 | Bolan . | |
| 3,977,988 | 8/1976 | Tokiwa et al. . | |
| 4,088,596 | 5/1978 | Arai et al. . | |
| 4,105,827 | 8/1978 | Brichard et al. . | |
| 4,156,039 | 5/1979 | Klebe et al. | 427/215 |
| 4,194,025 | 3/1980 | Klebe et al. . | |
| 4,395,344 | 7/1983 | Maddox | 252/99 |

OTHER PUBLICATIONS

"Chemical Basis for a Common Type of Drain Cleaner", C. H. Breedlove, Jr., *Chemistry* Magazine, Sep., 1971.

"Bleach Additives for Detergent Systems", Dibello et al., *Soap/Cosmetics/Chemical Specialties,* Aug., 1974.

"Interox Bets on Sodium Percarbonate Market", *Chemical and Engineering News.*

"Selection of Bleaching Agents for Dry Bleaches", John Parker, published in JAOCS, vol. 60, No. 6, (1983).

*Primary Examiner*—Paul Lieberman

*Assistant Examiner*—Linda D. Skaling

*Attorney, Agent, or Firm*—Price, Heneveld, Cooper, DeWitt & Litton

[57] ABSTRACT

A drain cleaning composition includes at least about 40% by weight of a free-flowing coated alkali metal hydroxide and about 5% to 20% by weight of mixture of a hypochlorite generator and a peroxide generator. The hypochlorite and peroxide generators react to release oxygen gas and hypochlorite ions, the hypochlorite generator being in stoichiometric excess over the peroxide generator to produce free hypochlorite ions for dissolving hair and other protein based clogs. The coating on the drain cleaning composition prevents the hydroxide from reacting with the other components of the mixture before the mixture is added to water.

30 Claims, No Drawings

DRAIN CLEANER

BACKGROUND OF THE INVENTION

This invention relates to drain cleaners.

Granular household drain cleaners currently available on the market typically include sodium hydroxide, sodium nitrate and aluminum, the sodium hydroxide being the predominant component of the mixture. The sodium hydroxide generates substantial heat as it dissolves in water, thereby melting clogging grease. The sodium nitrate, sodium hydroxide and aluminum react with water to produce ammonia. The gases generated agitate, at least somewhat, the sodium hydroxide so that it is dispersed throughout the water and does not clump. The ammonia then substantially dissolves in the water. The agitation also exposes the clog to fresh sodium hydroxide. If the clog is grease based, the heat of solution of the sodium hydroxide will melt the grease, and some of the grease will be saponified to a soluble soap-like substance.

However, the common household granular drain cleaner is not effective for removing clog aggravating hair which catches on the strainer or on mechanical parts of the stopper mechanism located at or near the top of the drain entry. Hair tends to catch on and hang down from such components and restrict the flow of draining fluid sufficiently that clog formation in the trap is encouraged. While the heat of dissolution of sodium hydroxide will dissolve hair actually located in the trap, hair hanging down from the strainer is too far above the trap to be affected by sodium hydroxide dissolving in the trap below. Frequently a large portion of the hair is located above the water retained in the trap and is not affected by the drain cleaner. The heat of dissolution tends to stay concentrated at the bottom of the trap. While some heat, of course, rises, it is typically not sufficient to dissolve hair hanging from the strainer.

Adding a hypochlorite generator to the granular drain cleaner would be effective in oxidizing such strainer suspended hair. However, hypochlorite generators are typically unstable with the sodium hydroxide in granular form because the two readily react. They cannot be stored for any length of time with each other. In addition, the ammonia, produced in the sodium nitrate reaction with aluminum in sodium hydroxide, will react with the hypochlorite to generate chloramines which can be dangerous. The chloramines at least have an unpleasant odor, and a potential for toxicity. Also it is a possibility, albeit remote, that the explosive trichloramine will form.

Liquid drain cleaners do contain 5 to 6% hypochlorite. The hypochlorite can coexist with the caustic without deterioration because the caustic is present in such dilute form, i.e., 6 to 8%. The significant drawback to liquid drain cleaners however, is that little or no heat is generated when they are added to the water in the drain. The sodium hydroxide is already dissolved and hence, the substantial heat of dissolution of the sodium hydroxide is not created in the clogged drain. This renders liquid drain cleaners much less effective than granular drain cleaners on most clogs.

SUMMARY OF THE INVENTION

The drain cleaner of the present invention incorporates a hypochlorite generator in a granular product without risk of chloramine formation. The conventional agitation system is eliminated altogether, and the hypochlorite generator is made a component of the agitation system. The novel drain cleaning composition includes at least about 40% by weight of a free-flowing coated alkali metal hydroxide and about 5% to about 20% by weight of a mixture of a hypochlorite generator and peroxide generator which react together and release oxygen gas and hypochlorite ions when dissolved in water. The coating is effective over substantial time periods to prevent the alkali metal hydroxide and hypochlorite generator from reacting with each other during storage, before they are added to water.

However, when placed in water, the components will generate oxygen gas which agitates and distributes the hydroxide in the water, and hypochlorite ions which oxidize protein material and dissolve hair. Thus, the drain cleaning composition of the present invention has the heat generating advantages of solid caustic for melting grease with the added hair dissolving abilities of hypochlorite generators. Yet, the potential for chloramine formation is eliminated.

DETAILED DESCRIPTION OF THE PREFERRED EMBODIMENT

The household drain cleaning composition of the present invention includes 40–90% by weight of a coated alkali metal hydroxide. Preferably the hydroxide is sodium hydroxide and is coated with a $C_{12}$–$C_{22}$ fatty acid monoethanolamide or equivalent material. The composition further includes 5–20% by weight of a gas generator mixture containing a hypochlorite generator such as a chlorinated isocyanurate and a peroxide generator, such as sodium percarbonate. The hypochlorite ion generated reacts with $H_2O_2$ to generate oxygen gas. Preferably, the hypochlorite generator is in stoichiometric excess in relation to the peroxide generator. Optionally, the composition can include 5–20% by weight of an initial effervescent system preferably composed of a blend of 60% sodium bicarbonate and 40% citric acid to agitate the components and prevent clumping of the sodium hydroxide before the hypochlorite and peroxide generators react to produce effervescent oxygen.

The alkali metal hydroxide used is preferably sodium hydroxide. Before coating, the caustic should have a particle size ranging from about 10 to about 45 U.S. Series mesh. This size range has been found to promote dissolution of the caustic, yet the particles are large enough that coating material requirements are minimized. Preferably, the particles are also spherical to minimize surface area and coating material requirements.

A wide variety of coatings can be used to coat the sodium hydroxide. Preferably a $C_{12}$–$C_{14}$ fatty acid monoethanolamide is used with a trace level of a pigment. The fatty acid amide can be applied in a molten state in a fluid bed, pan or falling curtain coater. The pigment is an important feature because it permits visual inspection of the coating during the coating process. If the coating is not yet thick enough, the white caustic will contrast with and show through the dyed coating material, and the coating process should be continued until the white caustic does not show through the coating. The preferred pigment is phthalocyanine blue.

Coatings applied in the molten state may include:

$C_{12}$–$C_{22}$ fatty acids and their derivatives, such as fatty acid esters, fatty acid amides, ethoxylated fatty acid amides, fatty alcohols, ethoxylated fatty alcohols, fatty amines, ethoxylated fatty amines;

$C_5$–$C_{12}$ dibasic acids and the same aforesaid derivatives;

Polyoxyethylene, polyoxyethylene/polyoxypropylene copolymers, synthetic or natural waxes.

It is also possible to apply the coatings with a suitable fast evaporating solvent. However, using a solvent increases the costs because of the expense of the solvent and because of the solvent recovery. Coatings applied from a solvent system may include acrylic acid or methacrylic acid polymers or copolymers, styrene/maleic anhydride copolymers, ethylene/maleic anhydride copolymers, cellulose acetate phthalate, ethyl cellulose, polyvinylpyrrolidone, vinylpyrrolidone/vinyl acetate copolymers, poly(methyl vinyl ether), poly(methyl vinyl ether/maleic anhydride) or alkyl esters of poly(methyl vinyl ether/maleic acid).

The coatings can be water soluble, water dispersible or soluble in a highly alkaline solution. Materials which are very water soluble perform well because they allow the hydroxide to dissolve quickly. However, extremely water soluble coatings may provide less protection from atmospheric moisture during storage. Such protection is necessary to prevent the components of the drain cleaning system from reacting prematurely prior to use in the drain. Therefore, it is desirable to use coatings which are fairly, but not exceedingly soluble in water. This is why the $C_{12}$–$C_{14}$ fatty acid monoethanol amides are preferred.

Water insoluble coatings can be employed if a mechanism is provided to cause the insoluble coating to break and release the sodium hydroxide. An example is ethyl cellulose, a water insoluble polymer, plasticized with a water soluble compound such as propylene glycol, resulting in a coating that is water insoluble, but water sensitive. When sodium hydroxide coated with a mixture of ethyl cellulose plasticized with propylene glycol is placed in water, the plasticizer dissolves, causing the ethyl cellulose coating to disperse and release sodium hydroxide. An example of a coating soluble in highly alkaline conditions is a styrene/maleic anhydride copolymer, which is water insoluble, but contains a number of anhydride functional groups. Following addition to water the alkalinity of the system reacts with the anhydride groups forming the sodium salt of the polymer, which is water soluble.

No matter what coating is used or how it is applied, the coating should have a melting point higher than any temperatures encountered during shipping and handling. Melting points ranging from 50°–90° C. are adequate for this purpose. If coatings having lower melting points are used, one runs the risk tht the coating will melt allowing the components of the drain cleaning composition to react prematurely during shipment, handling or storage.

Coatings should be approximately 6–20% of the weight of the sodium hydroxide, preferably between 8–15%. If less coating is applied, the hydroxide will not be coated sufficiently thick so that is will either absorb atmospheric water through the thin coating or the thin coating will break or fracture during handling, allowing exposed sodium hydroxide to absorb water or physically contact the chlorine donor. These conditions are to be avoided because they will prematurely initiate the reaction processes described below. Naturally, during processing and handling, it is also desirable to exclude moisture as much as practicable.

The hypochlorite release agent used in the drain cleaning composition is quite important not only for gas generation, but also for oxidizing hair which causes many clogs. Chlorinated isocyanurates are the preferred hypochlorite release agents because of better stability than chlorinated trisodium phosphate compounds. Sodium dichloroisocyanurate, sodium dichloroisocyanurate dihydrate, potassium dichloroisocyanurate, trichloroisocyanuric acid, 1,3-dichloro 5,5-dimethylhydantoin or lithium hypochlorite can be used. However, sodium dichloroisocyanurate dihydrate is preferred. The weight of the dichloroisocyanurate should range from 3% to 15% in the entire drain cleaning mixture. Below the 3% minimum, not much gas is generated and the hypochlorite produced is only marginally effective on hair clogs. The 15% maximum is set merely for economic reasons because dichloroisocyanurates are relatively expensive. The only theoretical upper limit is where the fraction of hypochlorite release agent is so large that the caustic levels are reduced to levels where sufficient heat is not generated when an economic amount of cleaner is placed in a drain. The preferred level of the dichloroisocyanurate is about 8% by weight in the entire composition. Furthermore, there should be a stoichiometric excess of the hypochlorite release agent over the peroxygen compound so that the hypochlorite agent can release free hypochlorite ions for oxidation purposes.

The peroxygen compound used in the drain cleaning composition of the present invention produces hydrogen peroxide on dissolution in water. The peroxide reacts with the hypochlorite ions producing oxygen. The oxygen gas generated agitates the sodium hydroxide in solution. Suitable peroxy compounds include sodium percarbonate (sodium carbonate peroxyhydrate), sodium perborate monohydrate or sodium perborate tetrahydrate, and potassium monopersulfate. Sodium percarbonate is the preferred peroxy compound because of its availability and cost. Sodium percarbonate should range from about 2% to about 15% by weight if the entire mixture is to be effective. Six percent is preferred. These percentages refer to the percentage of peroxide generator per se, and not to the percentage of agglomerated mixture thereof, since the agglomerated mixture as described below will include some inactive ingredients whose sole function is to facilitate agglomeration. Again, the peroxygen compound should be in quantities stoichiometrically less than the hypochlorite release agent. The total percent by weight of peroxide generator (active) and hypochlorite generator is from about 5 to about 20% of the total composition.

It is preferable to agglomerate the sodium percarbonate because it is commonly available only in 40–100 U.S. Series mesh grain sizes. Therefore, segregation problems would normally be experienced if the 40–100 U.S. Series mesh sodium percarbonate were added to the 10–45 mesh sodium hydroxide. The alternative of grinding the sodium hydroxide to reduce its particle size range to that of the sodium percarbonate is not a commercially viable option because that increases the quantity of coating material required. Yet, agglomeration of sodium percarbonate is difficult because it is unstable in the presence of moisture, a necessary agent in the agglomeration process.

Accordingly, a novel sodium percarbonate agglomerating process is used. The sodium percarbonate to be agglomerated is placed in an agglomerator, e.g., a conventional rotating drum or falling curtain agglomerator, with anhydrous sodium carbonate, the sodium carbonate being equal in weight to about 0.60% of the entire drain cleaner composition. Such agglomerators typically have a drum with openings at each end, and paddles positioned spacedly around the inside surfaces of drum. The drum is rotatable about its longitudinal axis on drive rollers which rotate and are driven in tandem by drive means. Such equipment is well-known to those skilled in the art.

The sodium percarbonate/sodium carbonate mixture is tumbled in the rotating drum. As the mixture is falling in a curtain, an aqueous solution of about 40% by weight of sodium silicate is sprayed by a nozzle onto the falling curtain.

Preferably, the sodium silicate solution is heated to about 50°-60° C. to reduce its viscosity before being sprayed. However, the atomization of the solution by the nozzle reduces its temperature prior to contact with the falling curtain. The aqueous sodium silicate is absorbed by the percarbonate/carbonate mixture. Notwithstanding sodium percarbonate's high reactivity with water, very little of the water in the silicate solution reacts with the percarbonate. The anhydrous sodium carbonate hydrates the water preferentially from the silicate solution. A small, but significant amount of the water also evaporates as it is injected through the nozzle. To draw the evaporated water from the drum, air at ambient temperature is drawn through the agglomerator by suction.

Since the water either evaporates and/or is hydrated by the sodium carbonate, the silicate will become quite tacky, and will coat and adhere to the particulate percarbonate/carbonate blend. The tacky coating causes the particles to stick together and form larger particles. Altogether, sodium silicate should be sprayed in an amount equal to about 0.25% (solids) of the entire drain cleaner composition, not including the water used as a carrier to spray it.

The circulation of ambient air through the falling curtain while the aqueous silicate is being sprayed also cools the mixture. Sodium carbonate exothermally hydrates water, so it is necessary to cool the agglomerating percarbonate to prevent the temperature from rising to unacceptable levels. Such cooling prevents the percarbonate from decomposing.

After the aqueous sodium silicate is sprayed, the agglomerated sodium percarbonate mixture immediately must be dried to drive off excess water to prevent it from reacting with the percarbonate. This is done by drawing 60°-80° C. air past the falling curtain until the mixture in the rotating drum reaches a temperature of about 45°-55° C. When the agglomerated powder reaches this temperature, most of the unstable hydrates of sodium carbonate and sodium silicate are decomposed. The resulting free water is evaporated so it will not be present in the drain cleaner to react with the percarbonate or any other ingredients during long term storage. In this way, we eliminate from the agglomerated percarbonate blend any hydrates which are unstable below 45°-55° C. and therefore which might be decomposed and release water during storage which would cause the percarbonate to decompose and destroy its later effectiveness in the compound when introduced into a clogged drain.

The agglomerated percarbonate mixture should comprise at least about 50% sodium percarbonate, and preferably at least about 80% by weight sodium percarbonate. The remainder of the mixture will comprise, of course, sodium carbonate, sodium silicate and some water. The sodium silicate comprises about 4% solids by weight of the agglomerated mixture.

It is important, however, that the bed temperature not exceed 45°-55° C. during heating because sodium percarbonate will decompose. When peroxide is released prematurely in this fashion, the mixture is rendered useless.

It is desirable to have an initial effervescent system in the composition which generates a gas immediately upon addition to the water before the sodium hydroxide dissolves and before much oxygen is generated by the reaction between the hypochlorite generator and the peroxy compound. The initial effervescent system includes 20-55% by weight of a solid acid such as a boric, citric, adipic, fumaric, malic, succinic or tartaric acid. Organic acid anhydrides such as succinic anhydride can be used as well. The preferred acid is citric acid because it is commonly available and relatively inexpensive. The initial effervescent system also includes 40-70% by weight of a carbonating agent, namely, an alkali carbonate such as sodium or potassium bicarbonates, sodium or potassium carbonate, or sodium sesquicarbonate. However, sodium bicarbonate is the preferred carbonating agent because of its low cost. The foregoing initial effervescent can be prepared using known compaction or agglomeration methods.

A drying agent such as calcium sulfate, silica gel, calcium chloride, calcium oxide or alumina can be added while formulating the initial effervescent system to increase its shelf life. Generally, the drying agent should comprise no more than about 5 to about 30% of the weight of the initial effervescent system. Lubricants and binders can also be included in the initial effervescent system to improve processing (0.5 to 5.0% by weight of the initial effervescent system). Such lubricants and binders include organic acids, dimethylpoly siloxanes, and ethoxylated alcohols.

To prevent dusting, mineral oil can be added to the drain cleaning composition in an amount about equal to 0.1-1.0% by weight of the entire composition. Other miscellaneous ingredients of the composition include surfactants, fillers, fragrances, bulking agents, corrosion inhibitors such as sodium silicate, and anticaking or flow agents.

When the drain cleaning composition is added to water, a series of reactions take place. The initial effervescent system (sodium bicarbonate and the citric acid) is the first to react producing carbon dioxide which agitates the other ingredients, preventing them from clumping and allowing them to react more quickly.

Before the initial effervescent system completes its reaction, the primary effervescent system begins to react. First, the sodium percarbonate dissolves in the water to produce sodium carbonate and hydrogen peroxide according to the following expression:

$$2Na_2CO_3.3H_2O_2 \xrightarrow{H_2O} 2Na_2CO_3 + 3H_2O_2$$

In solution, the sodium dichloroisocyanurate dihydrate reacts with the water to produce hypochlorous acid:

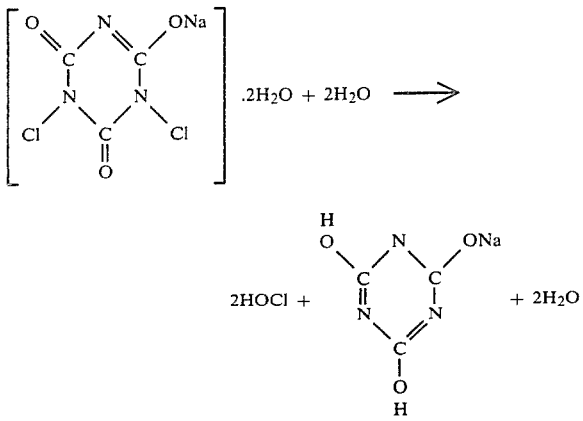

The HOCl is immediately neutralized by the vast excess of NaOH, forming the hypochlorite ion which reacts with the hydrogen peroxide to produce oxygen:

$$NaOCl + H_2O_2 \rightarrow NaCl + O_2 + H_2O$$

The oxygen generated by the peroxide/sodium dichloroisocyanurate reaction vigorously agitates the ingredients, distributing the sodium hydroxide throughout the water as the sodium hydroxide begins to dissolve. It is important that there be vigorous agitation because the turbulence generated aids in dissolving the sodium hydroxide. If the turbulence were not present, the sodium hydroxide would not dissolve completely and the heat necessary for melting grease clogs would not be generated. Insufficient turbulence can result in the formation of a heel, a solid mass of hydrated sodium hydroxide, which can also clog a drain.

As indicated above, the sodium dichloroisocyanurate dihydrate is in stoichiometric excess over the sodium percarbonate. The portion of the sodium dichloroisocyanurate which has not reacted with the hydrogen peroxide produced by the sodium percarbonate reacts with water to generate excess hyochlorous acid. The sodium hydroxiode neutralizes the hypochlorous acid to sodium hypochlorite which oxidizes hair and protein.

The sodium hydroxide, the largest fraction of the composition, has a high heat of solution. Therefore, as the hydroxide dissolves, it generates heat in sufficient amounts to melt fats. It also saponifies some of the fats to create a soluble soap which can be washed away.

A most preferred embodiment formula for the present invention is as follows:

| | | |
|---|---|---|
| Coated Caustic | | |
| $C_{12}$—$C_{14}$ Fatty acid monoethanolamide | 9.00% | 74.7% |
| Phthalocyanine blue pigment | .12% | |
| Sodium hydroxide | 90.88% | |
| | 100.00% | |
| Initial Effervescent System | | |
| Citric acid | 31.00% | 11.0% |
| Sodium bicarbonate | 49.00% | |
| Calcium sulfate | 20.00% | |
| | 100.00% | |
| Peroxide Source | | |
| Sodium silicate solution (40% solids) | 10.00% | 6.2% |
| Water | 1.00% | |
| Sodium carbonate | 12.00% | |
| Sodium percarbonate | 80.00% | |
| | 103.00%* | |

-continued

| | |
|---|---|
| Hypochlorite Generator | |
| Sodium dichloroisocyanurate dihydrate | 8.0% |
| Misc. | |
| Mineral Oil | 0.1% |
| | 100.0% |

*Approximately 3% water loss to evaporation.

EXPERIMENTAL RESULTS

Experiments were performed testing the effectiveness of the drain cleaning composition of the present invention against soap curd clogs. In one such experiment, soap curd was prepared by dissolving 300 grams of 85% tallow/15% coconut soap in 3 liters of deionized water. After the soap dissolved, a solution containing 300 milliliters of deionized water, 55 grams of calcium chloride ($CaCl_2.2H_2O$) and 52 grams of magnesium chloride ($MgCl_2.6H_2O$) was added. The resulting soap curd was filtered from the water and dried to a paste containing 34% solids and having a 3:2 calcium to magnesium molar ratio blend of calcium and magnesium soaps.

Ten grams of the soap curd were spread over the inside of one end of a 6 inch long 1½ inch inside diameter glass pipe. The curd was spread over a 2¾ inch length of the pipe. A rubber stopper was then placed in the end of the pipe and the pipe was supported in a vertical position with the stopper at the bottom. One hundred milliliters of warm water (40° C.) were added to the glass trap followed by 20 grams of the drain cleaning composition of the present invention. After 10 minutes, the glass pipe was emptied and flushed with 100 milliliters of warm water. Only traces of the soap curd remained in the pipe, and the small particles of curd in the water passed through a 50 mesh screen.

A standard household drain cleaning product consisting predominantly of sodium hydroxide, sodium nitrate and aluminum was also tested with the soap curd procedure described above. It was added to the soap curd according to label instructions, with 30 grams of product being added to water having a temperature of 20° C., and being allowed to stand for 15 minutes. The soap curd was cleaned from the pipe, but only a very small fraction of the curd passed through the 50 mesh screen, indicating that the standard drain cleaning product did not break up the soap curd as well as the drain cleaning composition of the present invention did. Twenty percent more product was used for a 50% longer time period when testing the standard drain cleaning product, but did not produce equivalent results.

The drain cleaner of the present invention was also compared with the standard sodium hydroxide/sodium nitrate/aluminum drain cleaner for grease clog performance. A 1½ inch inside diameter glass trap which conformed to the shape and dimensions of a typical sink trap was filled with water to fill the bottom of the U-bend. Thirty milliliters of molten hydrogenated vegetable shortening were poured onto the surface of the water. After cooling, a solid plug of grease resulted, approximately 2.5 cm in length. After aging the grease clog for 12 to 18 hours, 100 milliliters of water (40° C.) were poured on the top of the clog, followed by 20 grams of the drain cleaner of the present invention. On the average (over 10 tests), it took about 144 seconds for the grease clog to dislodge. Ten minutes after the drain cleaning composition was added, 2,000 milliliters of 40°

C. water were flushed through the trap. Any pieces of solid grease flushed from the drain were retained on a 10 mesh screen. On the average, about 69% of the solid grease was degraded based upon the solid grease retained on the screen.

The same test was run on the standard drain cleaning product except that 20° C. water was used with 30 grams of product and 15 minutes was allowed before the trap was flushed out, as directed by the label instruction. On the average, it took about 162 seconds for the clog to break loose and about 67% of the clog was degraded. It can be seen, therefore, that the drain cleaning composition of the present invention is at least as effective on grease clogs as the standard sodium hydroxide/sodium nitrate/aluminum drain cleaning composition.

It should be observed that most standard granular drain cleaning compositions cannot utilize warm water. When warm water is used with the standard drain cleaning composition, rapid boiling results which can cause spattering of the dissolved hydroxide. Because the sodium hydroxide in the drain cleaning composition of the present invention is coated, however, the sodium hydroxide dissolves more slowly in the warm water. The use of warm water is desirable because the heat generated on dissolution of the sodium hydroxide is not wasted heating the cold water in the drain. The heat generated is used for melting grease clogs or dissolving soap curd.

Finally, the addition of the hypochlorite release agent in the drain cleaning composition of the present invention provides an effective way to oxidize hair and other protein based clogs.

HANGING HAIR TEST RESULTS

A test was also designed to determine degradation of hair hanging into a water trap. The level of degradation can be determined above and below the waterline. Small paper clips were placed at approximately 3 cm intervals along the length of a 28 cm swatch of hair. The drain cleaner to be tested was placed in a 250 ml graduated cylinder and the hair swatch was suspended from the top of the cylinder so that it hung in a vertical position to a point just above the bottom of the cylinder. One hundred fifty ml of water was poured into the graduate and it was allowed to set for the time period corresponding to label instructions of the product being tested. At the end of the specified time period the hair swatches were removed and evaluated for the height fully degraded and partially degraded.

The drain cleaner of this invention was compared in this test with a granular drain cleaner on the market consisting predominantly of sodium hydroxide, sodium nitrate and aluminum. The commercial drain cleaner was tested for 15 minutes at a use level of 30 grams and the initial water temperature was 20° C. (cold tap water) as directed on the label. The drain cleaner of this invention was tested for 10 minutes at a 20 gram use level with 40° C. (warm) water.

The commercial drain cleaner completely degraded the hair up to approximately the 75 ml mark, which is about one-half the length of the hair swatch that was submerged in the water. The remaining hair that was submerged in the solution (to the 150 ml mark) was visibly swollen. The composition of this invention caused a complete degradation to about the 30 ml mark and visibly swelled the hair to approximately the 160 ml mark.

The test was run a second time on both swatches of hair with the corresponding products. This would simulate a second application as is recommended when a drain obstruction is not completely removed.

The commercial drain cleaner caused additional swelling of the hair in contact with the liquid but there was no significant additional reduction in length. The composition of this invention caused the hair to completely degrade to approximately the 160 ml mark and produced significant swelling to the 200 ml mark. The foam produced rose in the cylinder and was capable of degrading hair above standing water.

The commercial product had a tendency to produce two layers in the graduated cylinder on dissolution in water. The lower layer comprised approximately 50% of the volume and had a high product concentration and temperature. The upper layer was relatively dilute and had a significantly lower temperature. The lower layer aggressively attacked the hair, but the upper layer had significantly lower activity towards degradation of hair. The effervescent system in the drain cleaner of this invention was sufficiently vigorous to produce more uniform drain cleaning solution. This difference was demonstrated by measuring the temperature at the top and bottom of the liquid in the graduated cylinders following 15 minutes dissolution time. The commercial product was 75° C. at the bottom of the water and 30° C. at the top. The composition of invention had a 68° C. bottom temperature and 60° C. at the top. The higher temperature at the top of the water increases the rate of degradation of hair.

CONCLUSION

From the above, it is apparent that the drain cleaning composition of the present invention is effective on a wide variety of drain clogs: on grease drain clogs in kitchen drains, on hair based drain clogs in bathroom drains, and on soap drain clogs in both types of drains. Having described preferred embodiments of the invention, it will be recognized by those skilled in the art that modifications can be made without departing from the principals of the invention. Such modifications are to be considered as included in the appended claims unless these claims, by their language, expressly state otherwise.

The embodiments of the invention in which an exclusive property or privilege is claimed are defined as follows:

1. A free flowing crystalline drain cleaner composition, comprising a mixture of:
   - at least about 40% by weight of a free-flowing, alkali metal hydroxide;
   - about 5 to about 20% by weight of a mixture of a hypochlorite generator and peroxide generator which react to release oxygen gas when dissolved in water, whereby said oxygen gas generated will agitate and distribute said hydroxide in the water;
   - said alkali metal hydroxide being coated with a coating which is effective over substantial time periods to prevent said alkali metal hydroxide and hypochlorite generator from reacting with each other before they are added to water; and
   - said hypochlorite generator being in stoichiometric excess in relationship to said peroxide generator to provide free hypochlorite ions which will oxidize protein materials, said percentages by weight being based on the total weight of the composition.

2. The drain cleaner composition as recited in claim 1 wherein said coating material is selected from water soluble materials.

3. The drain cleaner composition as recited in claim 1 wherein said coating material includes a water insoluble material and a releasing substance causing said water insoluble material to release said hydroxide when the composition is placed in water.

4. The drain cleaner composition as recited in claim 1 which further comprises an initial effervescent system including an alkali carbonate and an acid.

5. The drain cleaner composition as recited in claim 4 wherein said initial effervescent system comprises about 5 to about 20% by weight of said composition.

6. The drain cleaner composition as recited in claim 5 wherein said acid comprises about 20 to about 55% by weight of said initial effervescent system and is selected from the group consisting of: boric acid, citric acid, adipic acid, fumaric acid, malic acid, succinic acid, tartaric acid, or acid anhydrides of any of the aforesaid acids.

7. The drain cleaning composition as recited in claim 6 wherein said alkali carbonate comprises about 40 to about 70% by weight of said initial effervescent system and is selected from the group consisting of: sodium bicarbonate, potassium bicarbonate, sodium carbonate, potassium carbonate, or sodium sesquicarbonate.

8. The drain cleaner composition as recited in claim 5 wherein said initial effervescent system includes sodium bicarbonate and citric acid.

9. The drain cleaner composition as recited in claim 4 wherein said hypochlorite generator comprises a chlorinated isocyanurate.

10. The drain cleaner composition as recited in claim 9 wherein said peroxide generator comprises a peroxy compound selected from sodium percarbonate, sodium perborate and potassium monopersulfate.

11. The drain cleaner composition as recited in claim 1 wherein said hypochlorite generator comprises a chlorinated isocyanurate.

12. The drain cleaner composition as recited in claim 11 wherein said peroxide generator comprises a peroxy compound selected from sodium percarbonate, sodium perborate and potassium monopersulfate.

13. The drain cleaner composition as recited in claim 1 wherein said peroxide generator comprises a peroxy compound selected from sodium percarbonate, sodium perborate and potassium monopersulfate.

14. The drain cleaner composition as recited in claim 13 wherein said peroxide generator comprises an agglomerated sodium percarbonate, including about 80% by weight of sodium percarbonate and agglomerating agents to agglomerate small particles of sodium percarbonate into larges ones.

15. The drain cleaner composition as recited in claim 14 wherein said agglomerating agents includes sodium silicate and sodium carbonate.

16. The drain cleaner composition as recited in claim 15 wherein said sodium silicate comprises about 4% solids by weight of said agglomerated substance.

17. The drain cleaner composition as recited in claim 16 wherein said agglomerated substance further includes about 10% by weight of a hydrating agent.

18. The drain cleaner composition as recited in claim 17 wherein said hydrating agent comprises sodium carbonate.

19. The drain cleaner as recited in claim 1 wherein the coating on the granules of said alkali metal hydroxide is selected from the group consisting of: $C_{12}$–$C_{22}$ fatty acids and their derivatives, including fatty acid esters, fatty acid amides, ethoxylated fatty acid amides, fatty alcohols, ethoxylated fatty alcohols, fatty amines, ethoxylated fatty amines; $C_5$–$C_{12}$ dibasic acids and the same aforesaid derivatives; polyoxyethylene glycol, polyoxyethylene/polyoxypropylene copolymers, synthetic waxes, natural waxes, acrylic acid polymers, methacrylic acid polymers, styrene/maleic anhydride copolymers, ethylene/maleic anhydride copolymers, cellulose acetate phthalate, ethyl cellulose plasticized with propylene glycol, polyvinylpyrrolidone, polyvinylpyrrolidone/vinyl acetate copolymers, poly(methyl vinyl ether), alkyl esters of poly(methyl vinyl ether/maleic acid) and poly(methyl vinyl ether/maleic anhydride).

20. The drain cleaner composition as recited in claim 1 wherein said coating material has a melting point of between about 50° C. and about 90° C.

21. The drain cleaner composition as recited in claim 1 wherein said coating material is a fatty acid amide.

22. The drain cleaner composition as recited in claim 21 wherein said coating material is a C12–C14 monoethanolamide.

23. The drain cleaner composition as recited in claim 1 wherein said coating is water insoluble and comprises ethyl cellulose and a releasing substance which is propylene glycol which plasticizes the ethyl cellulose whereby said propylene glycol dissolves in water causing said ethyl cellulose to break up and release said hydroxide.

24. The drain cleaner composition as recited in claim 1 wherein a dye or pigment having a color contrasting with said hydroxide is added to said coating.

25. A free flowing crystalline drain cleaning composition, comprising a mixture of:

at least 40% by weight of a free-flowing, granular alkali metal hydroxide;

about 5 to about 20% by weight of a mixture of a hypochlorite generator and a peroxide generator which react to release oxygen gas when dissolved in water, said hypochlorite generator being in stoichiometric excess in relationship to said peroxide generator to provide free hypochlorite ions to oxidize protein material and dissipate the water;

said hydroxide being coated with a coating effective over substantial time periods to prevent said hydroxide and hypochlorite generator from reacting with each other before they are added to water;

said peroxide generator comprising an agglomerated sodium percarbonate including at least about 50% by weight of sodium percarbonate, and agglomerating agent means to agglomerate small particles of sodium percarbonate into large ones; and 5 to about 20% by weight of an initial effervescent system including an alkali carbonate and an acid, said percentages by weight being based on the total weight of the composition.

26. The drain cleaner composition as recited in claim 25 wherein said coating material is selected from water soluble materials.

27. The drain cleaner composition as recited in claim 26 wherein said coating material is a fatty acid amide.

28. The drain cleaner composition as recited in claim 27 wherein said coating material is a $C_{12}$–$C_{14}$ monoethanolamide.

29. The drain cleaner composition as recited in claim 25 wherein said coating material includes a water insoluble material and a releasing substance causing said water insoluble material to release said hydroxide when the composition is placed in water.

30. The drain cleaner composition as recited in claim 29 wherein said water insoluble material is ethyl cellulose and said releasing substance is propylene glycol which plasticizes the ethyl cellulose whereby said propylene glycol dissolves in water causing said ethyl cellulose to break up and release said hydroxide.

* * * * *